US007007738B2

(12) United States Patent
Goya Arcelus

(10) Patent No.: US 7,007,738 B2
(45) Date of Patent: Mar. 7, 2006

(54) VERTICAL BOXLESS MOULD CASTING MACHINE

(75) Inventor: Ignacio Goya Arcelus, Vitoria (ES)

(73) Assignee: Loramendi, S.A., (ES)

( * ) Notice: Subject to any disclaimer, the term of this patent is extended or adjusted under 35 U.S.C. 154(b) by 0 days.

(21) Appl. No.: 10/479,437

(22) PCT Filed: Jun. 1, 2001

(86) PCT No.: PCT/ES01/00224

§ 371 (c)(1),
(2), (4) Date: Dec. 1, 2003

(87) PCT Pub. No.: WO02/096582

PCT Pub. Date: Dec. 5, 2002

(65) Prior Publication Data

US 2004/0144517 A1 Jul. 29, 2004

(51) Int. Cl.
*B22C 9/20* (2006.01)

(52) U.S. Cl. ..... 164/323; 164/213

(58) Field of Classification Search ..... 164/213, 164/323, 344, 401, 203, 168, 187
See application file for complete search history.

(56) References Cited

U.S. PATENT DOCUMENTS

| | | | | |
|---|---|---|---|---|
| 3,659,701 A | | 5/1972 | Taccone | |
| 4,180,156 A | * | 12/1979 | Popov et al. | 198/726 |
| 4,267,878 A | * | 5/1981 | Mogensen et al. | 164/187 |
| 4,442,882 A | * | 4/1984 | Achinger et al. | 164/187 |
| 4,540,036 A | * | 9/1985 | Jensen | 164/323 |
| 6,092,585 A | * | 7/2000 | Larsen et al. | 164/130 |

FOREIGN PATENT DOCUMENTS

| | | |
|---|---|---|
| EP | 0693337 | 1/1999 |
| ES | 383042 | 11/1972 |
| ES | 412779 | 12/1975 |
| ES | 440877 | 3/1977 |
| ES | 2150112 | 11/2000 |
| FR | 2160747 | 7/1973 |
| GB | 1 419 592 | * 12/1975 |

* cited by examiner

*Primary Examiner*—Len Tran
(74) *Attorney, Agent, or Firm*—Michael Best & Friedrich LLP

(57) ABSTRACT

The molding machine comprises a station (1) with a chamber (2) that is closed between a front plate (5) that can move and swivel and a rear plate (8) associated to an extraction piston (9), forming a shell (3) in said chamber (2) by blowing sand through an upper hopper (4). The shell (3) obtained is pushed by the piston (9) until the rear of a row of shells (3') placed on a conveyor (7) that places them opposite a casting station. The motion of the shell (3) pushed by the extraction piston (9) is independent of the motion of said piston after being incorporated in the row of shells, and is provided exclusively by the conveyor system (7), thereby providing a shorter working cycle while preventing deterioration of the shells as they are not compressed by the piston (9) when it pushes against the rear of the row of shells (3').

2 Claims, 4 Drawing Sheets

VERTICAL BOXLESS MOULD CASTING MACHINE

This application claims the benefit of International Patent Application No. PCT/ES01/00224 filed Jun. 1, 2001.

OBJECT OF THE INVENTION

The present invention relates to a vertical shell molding machine, improved in certain aspects to achieve an increased production by a shorter duration of the working cycle, as well as to prevent possible erosion, deformation or compressions of the shells, leading to an improved quality of the parts obtained.

BACKGROUND OF THE INVENTION

Shell molding machines basically consist of a molding chamber, fed by a sand hopper established above it, which chamber is closed by a movable swiveling front plate and by a rear plate established on the end of an extractor piston, with the sand being compacted by the opposing pressure of the two plates.

In this way shells are cyclically obtained that form two half-molds and which are extracted with the aid of the extraction piston from the molding chamber and set against each other and aligned to form a row that will be carried, step by step, along the corresponding work stations, passing through a station where the molds are filled with the melt and proceeding while the part is cooled, to eventually reach the subsequent sub-processes.

Obviously, the successive shells forming the row define molds into which the melt is cast and thus must be perfectly aligned and maintained abutting and closed with a certain pressure that allows withstanding the melt pressure.

Traditionally, the movement of the row of shells along the installation is provided by the action of the extraction piston on the last shell manufactured, such that the extraction piston not only positions the shell against the end of the shell row but pushes on it to make the entire row advance. In each cycle, that is, each time a new shell is produced, the extraction piston makes the entire row advance one step, so that in successive cycles the row of shells advances step by step along the entire installation.

This advance method for the shells has two obvious drawbacks: on one hand, the wear suffered by the bottom area of the shells as they rub against the floor when traveling through the installation; and, on the other, the compression of the shells as they are pushed by the extraction piston to make the entire row advance.

Also known are installations wherein the displacement and advance of the shells along the installation is initially effected by the piston and later by a conveyor system. An installation of this type is for example described in European Patent n° 0 693 337, which describes a conveyor system consisting of a series of longitudinal rails that can move forward or backward, towards or away from the molding station. In this way the extraction piston pushes the last shell obtained until it is placed on the rails of the conveyor system, leaving it against the row of previously formed shells, so that the conveyor system provides the stepwise advance of the row of shells thereafter.

Thus, as the extraction piston performs the first displacement of the shell to place it on the conveyor, the operation of the extraction piston depends on the position and working cycle of the conveyor system, so that it cannot push the shell out of the molding station until the conveyor system is in the position for receiving the shells. In this way the cycle or operation of the molding station is conditioned by the motion of the row of shells, so that any interruption or stoppage of the subsequent stations will affect the output of the molding station.

Specifically, the conveyor system consists of longitudinal rails free to travel over rollers, making the shell row advance one step, after which lateral clamps independent of the longitudinal rails firmly secure the last shell as the longitudinal rails of the conveyor recede until reaching the end of the molding station, so that the extraction piston can place another shell on the conveyor. With this type of installation the shells are subject to friction against the rails that form the conveyor system, so that in this case there would also be wear damaging the shell that may affect the quality of the parts obtained.

Furthermore, the lateral clamps must apply a great pressure on the last shell, as they must prevent the recession of the entire row of shells when the conveyor rails recede, thus resulting in compressions and deformations of this last shell that also reduce the quality of the parts obtained.

In addition, the following or pushing by the extraction piston in the initial movement of the shell until it is placed on the conveyor system requires a perfect synchronization of the motions of the conveyor system and the extraction piston, as otherwise slight differences in the position and/or speed may occur that would lead to friction between the shells, which would in turn result in a wear of the sand mold and eventually cause defects in the part.

French Patent FR 2 160 747 refers to a conveyor device for a vertical shell molding machine wherein the last shell manufactured by the shell molding machine is expelled by an extraction piston against a row of shells on a shell conveyor system. The conveyor device consists of a combination of fixed and mobile beams, said mobile beams providing the vertical movement of the row of shells at the same time the last shell is being pressed against the row of shells. This invention shows the same problems as the European Patent previously mentioned.

DESCRIPTION OF THE INVENTION

The vertical shell molding machine of the invention has been conceived to solve the aforementioned problems by making the motion of the shell, pushed by the extraction piston, completely independent of the movement of the row of shells; that is, the shell is pushed by the extraction piston according to the molding sequence and not according to the movement of the conveyor system. For this purpose, the extraction piston places the shell in an intermediate position defined on the end of the baseplate of the molding station, that is not part of the conveyor system, so that the extraction piston does not participate at any time in the advance of the row of shells as it travels along the installation. Thus, the row of shells does not advance by being pushed by the last shell extracted by the extraction piston but instead by the action of an independent conveyor system, so that as the motions of the extraction piston and the conveyor system are independent after the shell is obtained the piston will deposit it in the intermediate position and then move back to begin a new molding cycle, with the conveyor system being responsible for collecting the shell and effecting its advance integrated in the row of shells.

With the above-described operation process, dead waiting times are avoided and the programming and synchronization of the movements of the machines is simplified; in addition, the shells do not suffer any compression loads as they do not travel by the action of the extraction piston.

According to the machine object of the invention, the extraction piston carries the shell to an intermediate position or station provided at the end of the baseplate prolonging from the molding chamber, with the conveyor system interlinked at certain times so that the shell is placed by the extraction piston in said intermediate position without applying any pressure on the row of shells; at said position the row is collected and removed by the shell conveyor and advance system, which from this position onwards will perform the movement of the row of shells throughout the installation. For this purpose, the end of the baseplate is provided with a series of protrusions determining a comb-like arrangement that is complementary in size and shape of a series of loping bars that are part of the conveyor system and which, with the suitable operational sequence, are interlinked with the baseplate to remove the shell left by the extraction piston and make advance the row of shells. The loping bars system makes the row of shells advance without said shells suffering any friction or compression, thereby improving the quality of the parts obtained.

With the machine described the molding station is made independent of the movements of the conveyor system so that, even when the latter is not in a position for collection or intermediate position, the extraction piston can extract the shell from the molding chamber without interrupting the working cycle, positioning it on the end of the baseplate and receding to begin a new molding cycle. Naturally, in the normal operation both movements will be synchronized so that when the extraction piston deposits the shell in the intermediate position the conveyor is already interlinked and the shell is set against the end of the row of shells, with the entire row of shells subsequently being moved by the conveyor system.

With the above-described characteristics, the vertical shell molding machine has a number of advantages over conventional ones that can be summarized as follows:

- A shorter run is required of the extraction piston, as it does not have to reach the conveyor system but only an intermediate area independent of said conveyor system that is part of the baseplate of the machine;
- The working cycle is shortened, as the run of the extraction piston movement is reduced;
- A simpler programming of the motions, as it is not necessary to synchronize the motion of the piston and the conveyor belt, which as described before are fully independent;
- Erosion of the shells is prevented, as the movement of the row of shells is effected by the conveyor system without any friction between the shells and the elements of said conveyor system;
- Control of the shell position or of the closing pressure is simplified;
- The risk of shell compression by the pushing action is prevented, as the piston pushes it freely as far as the end area of the baseplate of the molding station, without pressing it against the row of shells nor making said row move or advance;
- Prevents dead waiting times of the machine, as once the shell has been left by the extraction piston in the intermediate position the extraction piston can be retracted to participate in the following cycle;
- Shortened working cycle as the stage in which the extraction piston accompanies the advance motion is eliminated.

DESCRIPTION OF THE DRAWINGS

As a complement of the description being made and in order to aid a better understanding of the characteristics of the invention, according to an example of a preferred embodiment, a set of drawings is accompanied as an integral part of the description where for purposes of illustration only and in a non-limiting sense the following is shown:

Thus, FIG. 1 shows the initial working stage with a shell obtained from the molding chamber, with the front plate displaced and swiveled to allow the extraction of said shell. In this figure the conveyor system is in the position for removing the shell after the extraction piston places it in the intermediate position.

FIG. 2 shows the shell being pushed by the corresponding piston, that places it in the intermediate position defined by the interposition of the molding station baseplate and the conveyor system bars.

FIG. 3 shows the shell in the same position, now with the clamps of the conveyor system holding the last shell obtained by its side. Previously, the advancing bars or rails have risen and are supporting the entire row of shells, including the last shell, while the fixed bars or rails are in a lowered position, that is, not in contact with the row of shells.

FIG. 4 shows the following stage in which the piston has retracted and the front plate is in the position closing the molding chamber, and in which the conveyor system has still not advanced the row of shells.

FIG. 5 shows the movement of the advance bars or rails, with the clamps holding the last shell, causing the friction-free movement of the entire row of shells.

FIG. 6 shows the retraction of the advance rails of the conveyor system, after the side clamps have released and the fixed rails have risen, so that the row of shells rests on the fixed rails while on the bottom the moving rails travel until they are again interlinked with the baseplate of the molding station.

PREFERRED EMBODIMENT OF THE INVENTION

Figure 1:
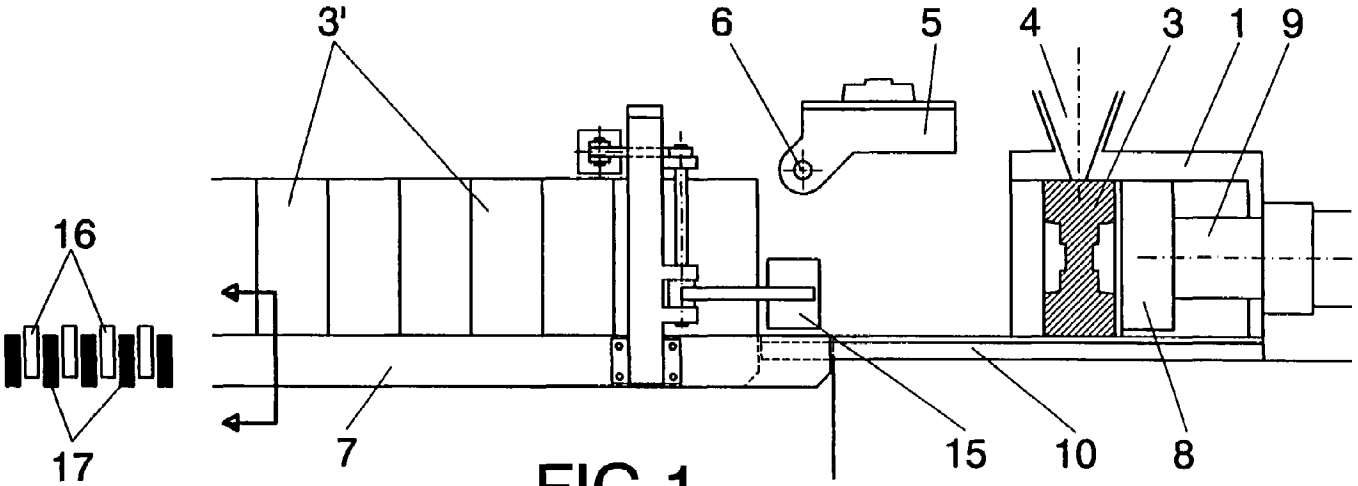
FIGS. 1 to 6 show the various operative stages or sequences of the vertical shell molding machine of the invention.
Figure 2:
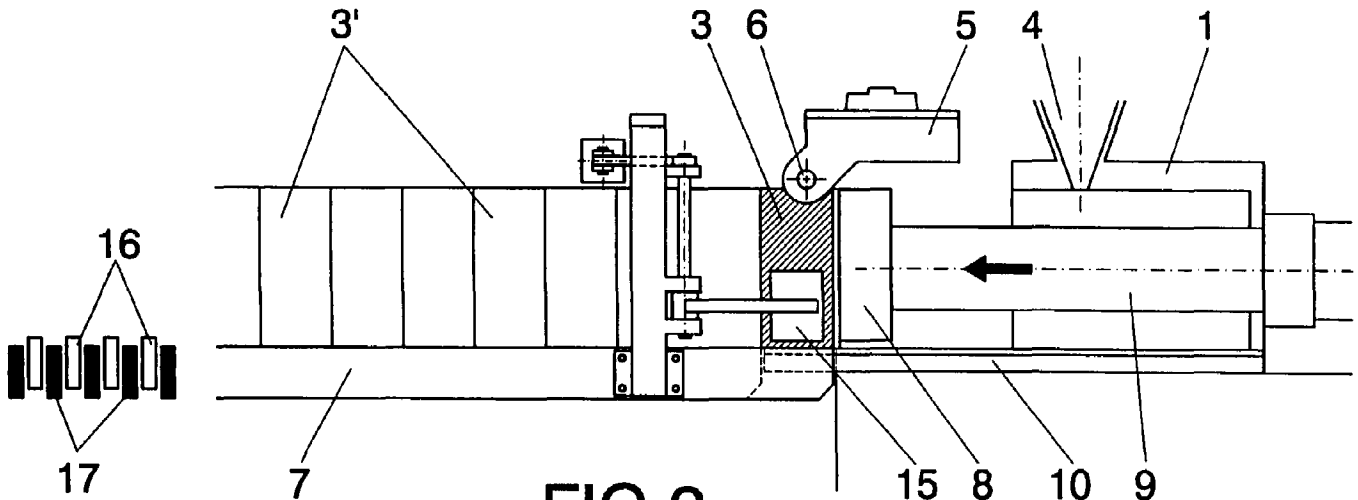
Figure 3:
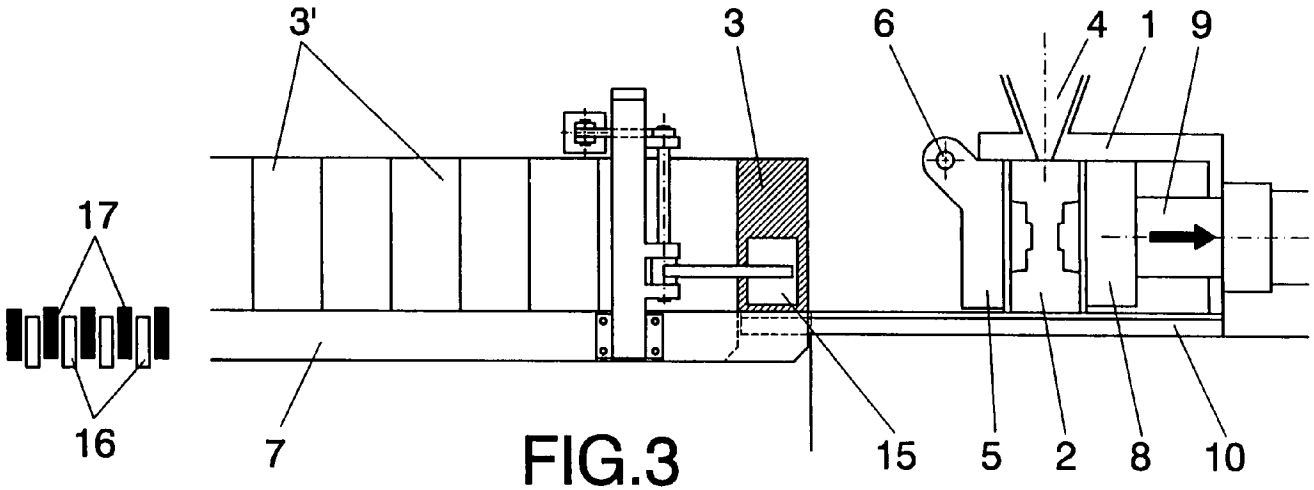

In view of the described figures, the machine of the invention as is conventional includes a molding station (1) in which is established a chamber (2) where the shell (3) is molded with the sand contained in a hopper (4) provided above. The chamber (2) is closed on its front by a front plate (5) that is displaceable and swivelable about a shaft (6) to allow the extraction and subsequent advance of the shell (3) obtained towards the row of shells (3') placed on the corresponding conveyor (7), while on its rear the chamber (2) is closed by a rear plate (8) associated to an extraction piston (9).

Said molding station (1) also includes the corresponding baseplate (10) by which the shell (3) is displaced from the chamber (2), on the end of said baseplate (10) being defined an intermediate position that at certain times is interlinked with a conveyor (7) consisting of a number of horizontal bars or rails on which rests the row of shells and that make the latter move along the installation, without the participation of the extraction piston (9).

The last shell produced in the molding chamber (1) is pushed by the extraction piston (9) until it is deposited at the intermediate position, with the shell resting on the end of the baseplate (10), regardless of whether the bars of the conveyor are interlinked or not with the baseplate. After this moment the extraction piston (9) can be retracted to begin a new cycle, with the conveyor system (7) being in charge of transporting both the last shell (3) deposited in the intermediate position and the row of previously produced shells (3') along the installation, without any participation of the extraction piston (9).

Figure 7:
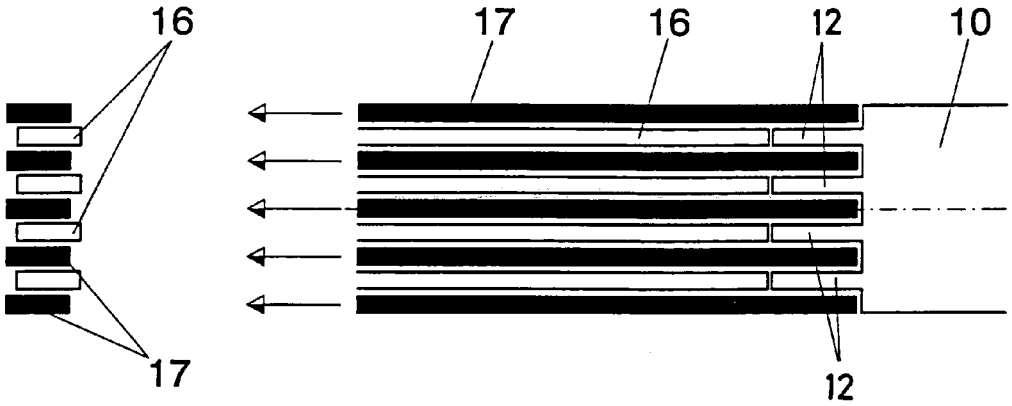
FIG. 7 shows, finally, a schematic plan view of the end of the baseplate of the molding machine, with a comb-like structure, and the fixed and advance bars or rails of the conveyor system for the row of shells, defining the interposition of the advance rails and the baseplate that defines the intermediate area or station for delivery and collection of the shells.

Specifically, and as shown in FIG. 7, the end of the baseplate has a number of protrusions (12) that determine a comb-like structure, complementary in size and shape of the advance bars or rails (17) of the conveyor system (7). These advance bars or rails (17) can move somewhat in a vertical sense and in a forward/backward sense, thereby forming a system of loping bars, so that they can retract until being interlinked with the baseplate (10) in the intermediate position to collect the shell deposited by the extraction piston (9). At this point the bars (17) advance to cause the displacement of the entire row of shells (3'), with all operations performed without the shells being subjected to pressure, compression or friction that could affect the final quality of the parts.

The conveyor system also incorporates fixed bars (16) that can only move up and down, which in certain cases support the row of shells (3'), mainly when the advance rails (17) are retracted to the intermediate position to collect the last shell produced.

The machine is completed by lateral clamps (15) that, by a slight pressure, hold the last shell when it is extracted or collected by the conveyor system (7) in order to prevent it from being left behind because of its inertia or by a possible suction effect caused by the extraction piston (9) as it retracts.

The operational sequence, as shown in FIGS. 1 to 6, is as follows:

The conveyor system (7) is at the shell collection position, that is, the fixed rails (16) are in their highest position and the advance rails (17) in the lowest position, overlapping with the comb-like end of the baseplate (10) that is integrally joined to the molding chamber. In this position the row of shells (3') rests only on the fixed rails (16). This position corresponds to FIG. 1.

The extraction piston (9) carries the shell out of the molding chamber (2) and places it at the intermediate position defined between the comb-like end of the baseplate (10) and the advance rails (17), with the shell being positioned only on the end of the baseplate (10) as the advance rails are in their lowest position. This position corresponds to FIG. 2.

The clamps (15) close on the shell deposited in the intermediate position, the advance rails (17) rise and the fixed rails (16) descend. The row of shells (3'), including the last shell (3), rests on the advance rails (17). This position corresponds to FIG. 3.

Figure 4:
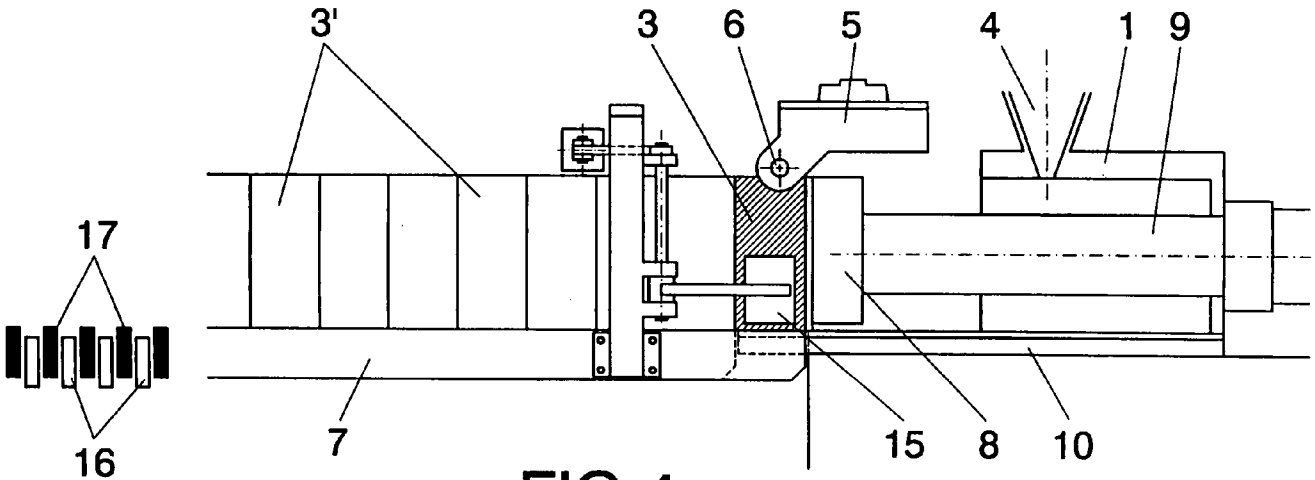
Figure 5:
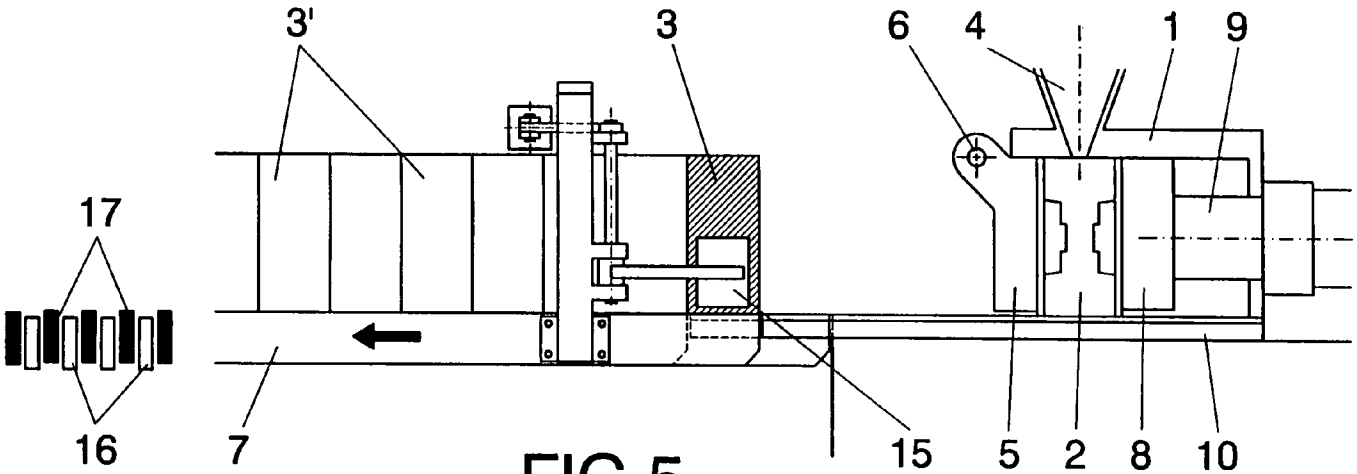

The extraction piston (9) retracts to the molding chamber (2) to begin a new cycle, as seen in FIG. 4.

The conveyor system (7) advances, that is, the advance rails (17) move forward, and with them the entire row of shells (3'). This position corresponds to FIG. 5.

Figure 6:
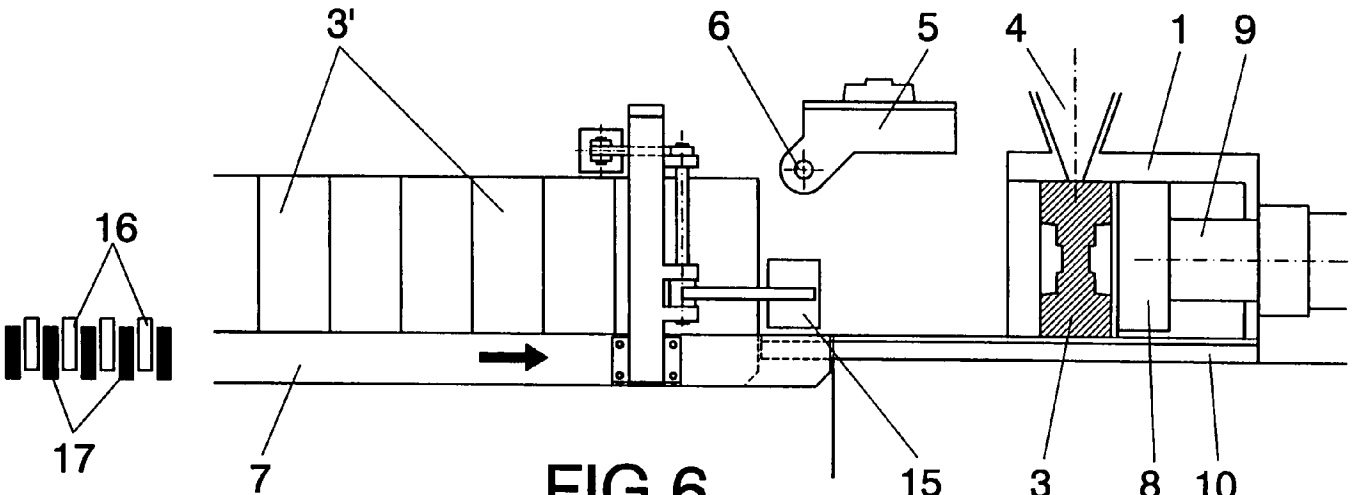

The fixed rails (16) rise and the advance rails (17) descend, so that the row of shells (3') rests on the fixed rails (16). The clamps (15) open and the advance rails (17) retract until they are interlinked with the end of the baseplate (10). This position is shown in FIG. 6.

In this manner the shell (13) placed by the extraction piston (9) in the intermediate position can be removed by the loping bars system without the shells suffering any pressure or friction.

What is claimed is:

1. Vertical shell molding machine, of the type including a molding chamber fed by the corresponding sand hopper and closed by a displaceable and swiveling front plate and by a rear plate provided on the end of an extraction piston, that compact the sand by applying opposing pressures, cyclically producing shells forming two half-molds that are placed on a baseplate and then, with the aid of the extraction piston, are, placed against each other and aligned to form a row of shells on a shell conveyor system, determining molds that move along the various working stations of the installation, characterized in that the shell is carried by the piston to an intermediate station interlinked with the shell conveyor system, the shell is deposited and placed against the last shell of the row such that the displacement of the row of shells is not performed by pushing the last shell expelled by the extraction piston against the previously obtained shells, and the shell is carried with the other shells step by step by the conveyor system, with a complete independence of the movement of the shell pushed by the piston and the movement of said shell after it is incorporated into the row of shells, said intermediate station being defined by protrusions of the baseplate, defining a comb-like structure, which when the shell is removed by the conveyor system are interlinked with the rails of a loping transport train, which rails are provided with an upward/downward and a forward/backward motion, and with which collaborate other rails that can only move in an upward/downward sense which move synchronically in each cycle to collect the shell, advance it one step and support the row formed.

2. Vertical shell molding machine, according to claim 1, characterized in that it incorporates clamps for supporting laterally the last shell incorporated to the row, with said clamps being integrally joined to the outer rails of the loping transport train.

* * * * *